US012669244B2

(12) United States Patent
Walters et al.

(10) Patent No.: US 12,669,244 B2
(45) Date of Patent: Jun. 30, 2026

(54) TURBINE ENGINE COMBUSTOR WALL WITH APERTURE DEFLECTOR

(71) Applicant: RTX Corporation, Farmington, CT (US)

(72) Inventors: Ian Walters, Corvallis, OR (US); Stephen K. Kramer, Crowmwell, CT (US); Baris A. Sen, S. Glastonbury, CT (US); Gary J. Dillard, Gainesville, FL (US); Eunice Allen-Bradley, Vernon, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/117,924

(22) Filed: Mar. 6, 2023

(65) Prior Publication Data

US 2024/0302042 A1 Sep. 12, 2024

(51) Int. Cl.

| | |
|---|---|
| ***F23R 3/00*** | (2006.01) |
| ***F23R 3/04*** | (2006.01) |
| ***F23R 3/06*** | (2006.01) |

(52) U.S. Cl.

CPC ..... *F23R 3/002* (2013.01); *F23R 3/04* (2013.01); *F23R 3/06* (2013.01)

(58) Field of Classification Search

CPC ..... F23M 5/08; F23M 5/085; F23R 3/002; F23R 3/04; F23R 3/045; F23R 3/06; F23R 3/50

See application file for complete search history.

(56) References Cited

U.S. PATENT DOCUMENTS

| | | | | |
|---|---|---|---|---|
| 2,541,171 | A | 2/1951 | Mcgarry | |
| 4,700,544 | A | 10/1987 | Fucci | |
| 5,187,937 | A | 2/1993 | Stevens | |
| 11,112,115 | B2 | 9/2021 | Kostka, Jr. | |
| 2007/0227149 | A1* | 10/2007 | Biebel | F23R 3/06 60/752 |
| 2017/0089579 | A1 | 3/2017 | Bunker | |
| 2017/0370588 | A1 | 12/2017 | Boardman | |
| 2020/0173660 | A1* | 6/2020 | Snyder | F23R 3/005 |
| 2020/0208840 | A1* | 7/2020 | Sauer | B22F 10/28 |
| 2023/0044804 | A1* | 2/2023 | Hu | F23R 3/002 |

OTHER PUBLICATIONS

EP Search Report for EP Patent Application No. 24161870.1 dated Jul. 4, 2024.

* cited by examiner

*Primary Examiner* — Scott J Walthour
(74) *Attorney, Agent, or Firm* — Getz Balich LLC

(57) ABSTRACT

An apparatus is provided for a turbine engine. This turbine engine apparatus includes a combustor wall, and the combustor wall includes a panel, a deflector and a quench aperture that extends along an aperture centerline through the combustor wall to an aperture outlet into a combustion chamber. The panel extends axially along and circumferentially about an axis. The panel extends radially between a first panel side and a second panel side. The first panel side forms a peripheral boundary of the combustion chamber. The panel forms a downstream side of the aperture outlet at the first panel side. The deflector projects out from the panel at the first panel side into the combustion chamber. The deflector forms an upstream side of the aperture outlet.

17 Claims, 10 Drawing Sheets

TURBINE ENGINE COMBUSTOR WALL WITH APERTURE DEFLECTOR

BACKGROUND OF THE DISCLOSURE

1. Technical Field

This disclosure relates generally to a turbine engine and, more particularly, to a combustor wall for the turbine engine.

2. Background Information

A floating wall combustor for a turbine engine typically includes a bulkhead, an inner combustor wall and an outer combustor wall. The bulkhead extends radially between the inner and the outer combustor walls. Each combustor wall includes a shell and a heat shield that forms a respective radial side of a combustion chamber. Cooling cavities extend radially between the heat shield and the shell. These cooling cavities fluidly couple impingement apertures in the shell with effusion apertures in the heat shield. Each combustor wall may also include a plurality of quench aperture bosses located between the shell and the heat shield. Each quench aperture boss at least partially forms a quench aperture through the combustor wall. While known combustor walls have various benefits, there is still room in the art form improvement. There is a need in the art, for example, for a combustor wall which can promote a more uniform pattern factor downstream of the quench apertures.

SUMMARY OF THE DISCLOSURE

According to an aspect of the present disclosure, an apparatus is provided for a turbine engine. This turbine engine apparatus includes a combustor wall, and the combustor wall includes a panel, a deflector and a quench aperture that extends along an aperture centerline through the combustor wall to an aperture outlet into a combustion chamber. The panel extends axially along and circumferentially about an axis. The panel extends radially between a first panel side and a second panel side. The first panel side forms a peripheral boundary of the combustion chamber. The panel forms a downstream side of the aperture outlet at the first panel side. The deflector projects out from the panel at the first panel side into the combustion chamber. The deflector forms an upstream side of the aperture outlet.

According to another aspect of the present disclosure, another apparatus is provided for a turbine engine. This turbine engine apparatus includes a combustor wall, and the combustor wall includes a panel, a deflector, a plurality of cooling apertures and a wall aperture that extends along an aperture centerline through the combustor wall to an aperture outlet into a combustion chamber. The panel extends axially along and circumferentially about an axis. The panel extends radially between a first panel surface and a second panel surface. The first panel surface forms a peripheral boundary of the combustion chamber. The deflector projects radially out from the panel into the combustion chamber to a deflector surface. The deflector partially forms the aperture outlet. The deflector surface slopes to the first panel surface as the deflector extends longitudinally from the aperture outlet. The cooling apertures project through the panel.

According to still another aspect of the present disclosure, another apparatus is provided for a turbine engine. This turbine engine apparatus includes a combustor wall, and the combustor wall includes a panel, a deflector and a quench aperture that extends along an aperture centerline through the combustor wall to an aperture outlet into a combustion chamber. The panel extends axially along and circumferentially about an axis. The panel extends radially between a first panel side and a second panel side. The first panel side forms a peripheral boundary of the combustion chamber. The deflector is integral with the panel. The deflector projects out from the panel at the first panel side into the combustion chamber. The deflector forms the aperture outlet with the panel. The deflector tapers towards the panel as the deflector projects longitudinally away from the aperture outlet.

The wall aperture may be configured as or otherwise include a quench aperture.

The panel may form a trailing edge side of the aperture outlet relative to flow within the combustion chamber. The deflector may form a leading edge side of the aperture outlet relative to the flow within the combustion chamber.

The deflector may project out from the panel to a deflector surface. A tubular surface of the combustor wall may form at least a portion of the quench aperture that extends along the aperture centerline to the aperture outlet. The tubular surface may be contiguous with the deflector surface.

A tubular surface of the combustor wall may form at least a portion of the quench aperture that extends along the aperture centerline to the aperture outlet. The tubular surface may be formed by the panel and the deflector.

The deflector may taper to the panel as the deflector extends longitudinally away from the aperture outlet to a leading end of the deflector.

A slope of the taper proximate the aperture outlet may be greater than a slope of the taper proximate the leading end of the deflector.

The deflector may taper to the panel as the deflector extends laterally to a first side of the deflector.

The deflector may taper to the panel as the deflector extends laterally to a second side of the deflector that is laterally opposite the first side of the deflector.

The deflector may project out from the panel to a deflector surface. An apex of the deflector surface may be located at the upstream side of the aperture outlet.

The deflector may extend circumferentially about the aperture outlet between sixty degrees and one-hundred and forty degrees.

The upstream side of the aperture outlet may be formed by a sharp edge of the deflector.

The downstream side of the aperture outlet may be formed by a sharp edge of the panel.

The downstream side of the aperture outlet may be formed by an eased edge of the panel.

The second panel side may be spaced from the aperture outlet along the aperture centerline by a first distance at the downstream side of the aperture outlet. The second panel side may be spaced from the aperture outlet along the aperture centerline by a second distance at the upstream side of the aperture outlet. The second distance may be greater than the first distance.

The combustor wall may also include a boss. The boss may project out from the panel at the second panel side. The boss may extend circumferentially around and may form an outer peripheral boundary of the quench aperture within the combustor wall.

The combustor wall may also include a heat shield and a shell. The heat shield may include the panel, the deflector and the boss. The heat shield may be attached to the shell. The boss may project out from the panel to a distal end of the boss. The distal end may engage the shell.

The combustor wall may also include one or more cooling apertures projecting through the panel.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
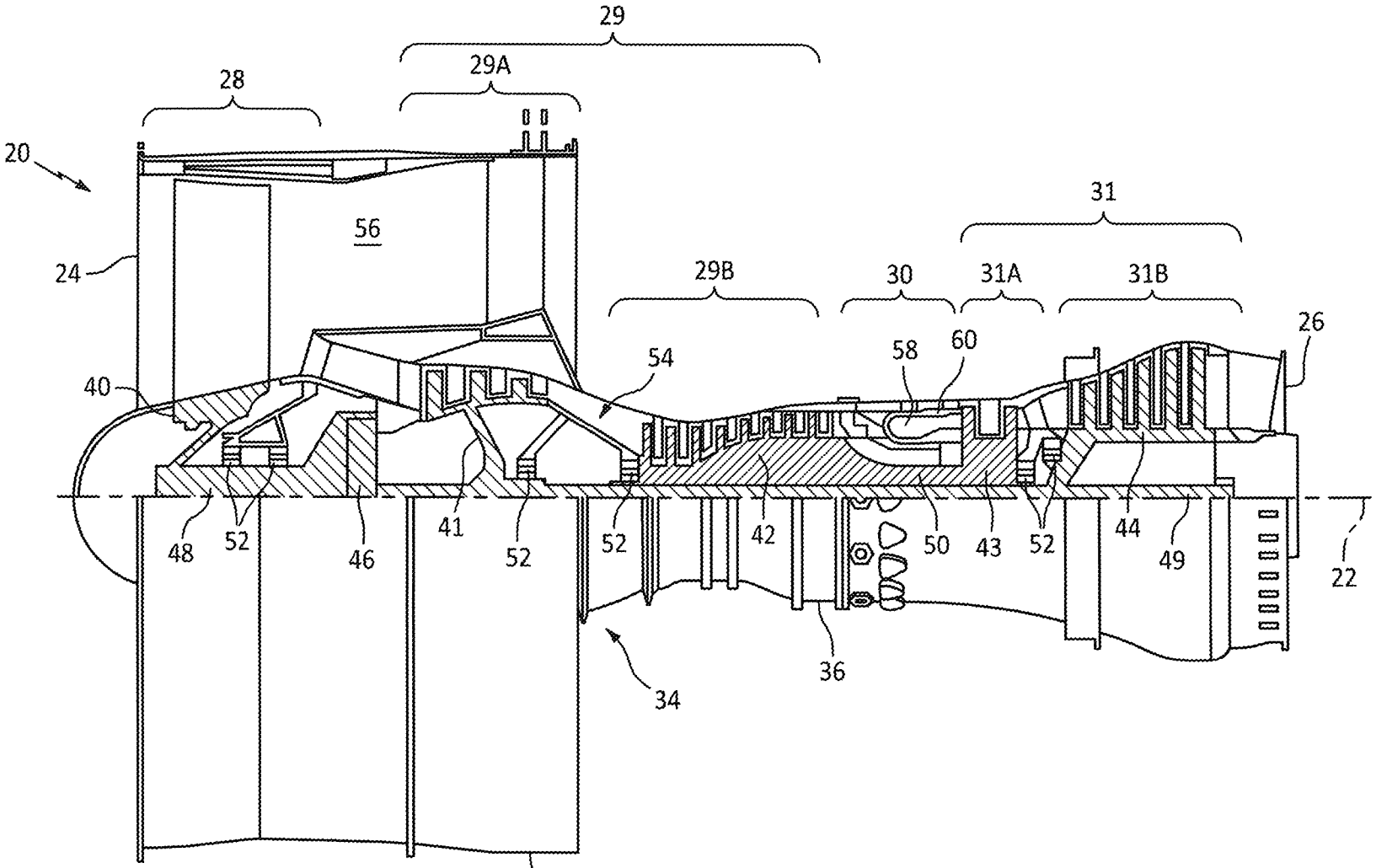
FIG. 1 is a side cutaway illustration of a geared gas turbine engine.

FIG. 1 is a side cutaway illustration of a geared gas turbine engine 20. This turbine engine 20 extends along a centerline axis 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B.

The engine sections 28-31B are arranged sequentially along the centerline axis 22 within an engine housing 34. This engine housing 34 includes an inner case 36 (e.g., a core case) and an outer case 38 (e.g., a fan case). The inner case 36 may house one or more of the engine sections 29A-31B; e.g., a core of the turbine engine 20. The outer case 38 may house at least the fan section 28.

Each of the engine sections 28, 29A, 29B, 31A and 31B includes a respective bladed rotor 40-44. Each of these bladed rotors 40-44 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 40 is connected to a geartrain 46, for example, through a fan shaft 48. The geartrain 46 and the LPC rotor 41 are connected to and driven by the LPT rotor 44 through a low speed shaft 49. The HPC rotor 42 is connected to and driven by the HPT rotor 43 through a high speed shaft 50. The shafts 48-50 are rotatably supported by a plurality of bearings 52; e.g., rolling element and/or thrust bearings. Each of these bearings 52 is connected to the engine housing 34 by at least one stationary structure such as, for example, an annular support strut.

During operation, air enters the turbine engine 20 through the airflow inlet 24. This air is directed through the fan section 28 and into a core flowpath 54 and a bypass flowpath 56. The core flowpath 54 extends sequentially through the engine sections 29A-31B; e.g., the engine core. The air within the core flowpath 54 may be referred to as "core air". The bypass flowpath 56 extends through a bypass duct, which bypasses the engine core. The air within the bypass flowpath 56 may be referred to as "bypass air".

The core air is compressed by the LPC rotor 41 and the HPC rotor 42 and directed into a combustion chamber 58 of a combustor 60 in the combustor section 30. Fuel is injected into the combustion chamber 58 and mixed with the compressed core air to provide a fuel-air mixture. This fuel-air mixture is ignited and combustion products thereof flow through and sequentially cause the HPT rotor 43 and the LPT rotor 44 to rotate. The rotation of the HPT rotor 43 and the LPT rotor 44 respectively drive rotation of the HPC rotor 42 and the LPC rotor 41 and, thus, compression of the air received from a core airflow inlet. The rotation of the LPT rotor 44 also drives rotation of the fan rotor 40, which propels the bypass air through and out of the bypass flowpath 56. The propulsion of the bypass air may account for a majority of thrust generated by the turbine engine 20.

Figure 2:
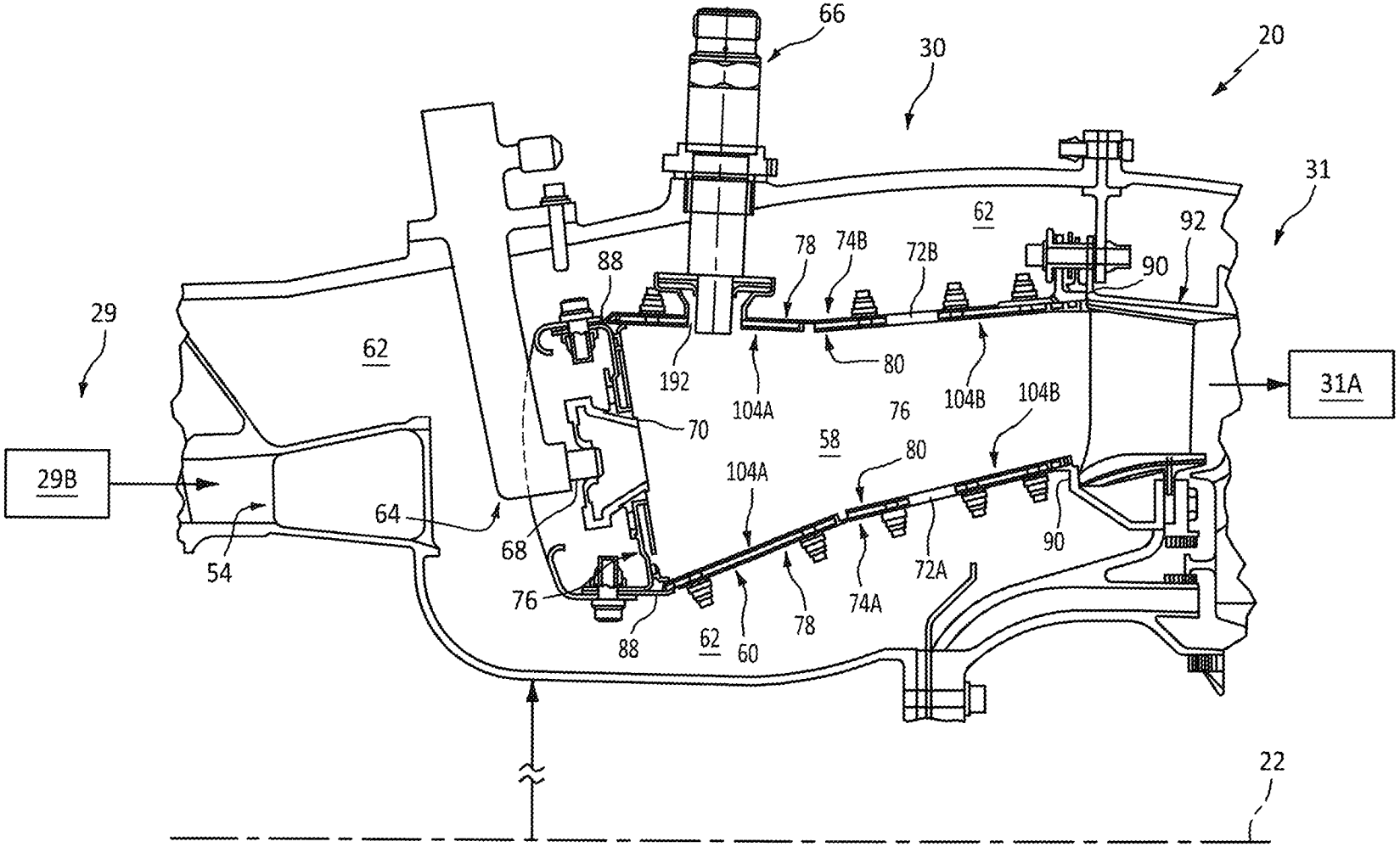
FIG. 2 is a side sectional illustration of a portion of a combustor section between a compressor section and a turbine section.
Figure 3:
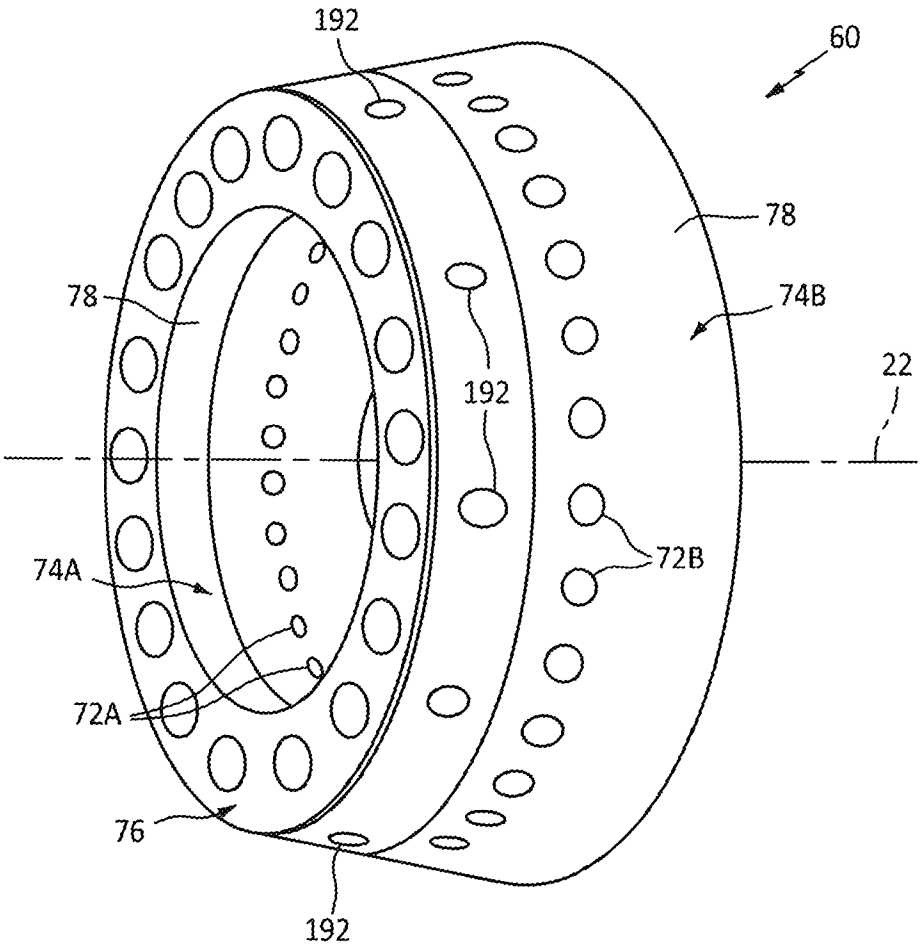
FIG. 3 is a perspective illustration of a combustor.

FIG. 2 illustrates a portion of the combustor section 30 along the core flowpath 54 between the HPC section 29B and the HPT section 31A. This combustor section 30 includes the combustor 60, a diffuser plenum 62, one or more fuel injectors 64 (one visible in FIG. 2) and one or more igniters 66 (one visible in FIG. 2). Briefly, the combustor 60 is disposed with (e.g., surrounded by) the diffuser plenum 62. This diffuser plenum 62 receives the compressed core air from the HPC section 29B, and provides the received core air for directing into the combustor 60. In particular, each fuel injector 64 may include a fuel nozzle 68 mated with an air swirler 70. The fuel nozzle 68 injects the fuel into the combustion chamber 58. The air swirler 70 directs some of the core air from the diffuser plenum 62 into the combustion chamber 58 in a manner that facilitates mixing the core air with the injected fuel. The igniters 66 ignite the fuel-air mixture within the combustion chamber 58. One or more quench apertures 72A, 72B (generally referred to as "72") (see also FIGS. 3-6) in each combustor wall 74A, 74B (generally referred to as "74") of the combustor 60 may direct additional core air from the diffuser plenum 62 into the combustion chamber 58 to quench (e.g., stoichiometrically lean) the combustion products; e.g., the ignited fuel-air mixture. With this arrangement, a majority of the compressed core air directed into the combustion chamber 58 from the diffuser plenum 62 flows through the air swirlers 70 and/or the quench apertures 72. However, an additional quantity of the compressed core air may be direct into the combustion chamber 58 from the diffuser plenum 62 through one or more cooling apertures; e.g., see FIG. 5.

The combustor 60 may be configured as an annular combustor; e.g., an annular floating wall combustor. The combustor 60 of FIGS. 2 and 3, for example, includes an annular combustor bulkhead 76, the tubular inner combustor wall 74A ("inner wall") and the tubular outer combustor wall 74B ("outer wall"). The bulkhead 76 of FIG. 2 extends radially between and to the inner wall 74A and the outer wall 74B. The bulkhead 76 may be connected (e.g., mechanically fastened or otherwise attached) to the inner wall 74A and/or the outer wall 74B. Each combustor wall 74 projects axially along the centerline axis 22 out from the bulkhead 76 towards the HPT section 31A. With this arrangement, the combustion chamber 58 is formed by and extends radially within the combustor 60 between the inner wall 74A and the outer wall 74B. The combustion chamber 58 is formed by and extends axially (in an upstream direction along the core flowpath 54) into the combustor 60 to the bulkhead 76. The combustion chamber 58 also extends within the combustor 60 circumferentially about (e.g., completely around) the centerline axis 22, which may configure the combustion chamber 58 as a full-hoop annulus.

Figure 4:
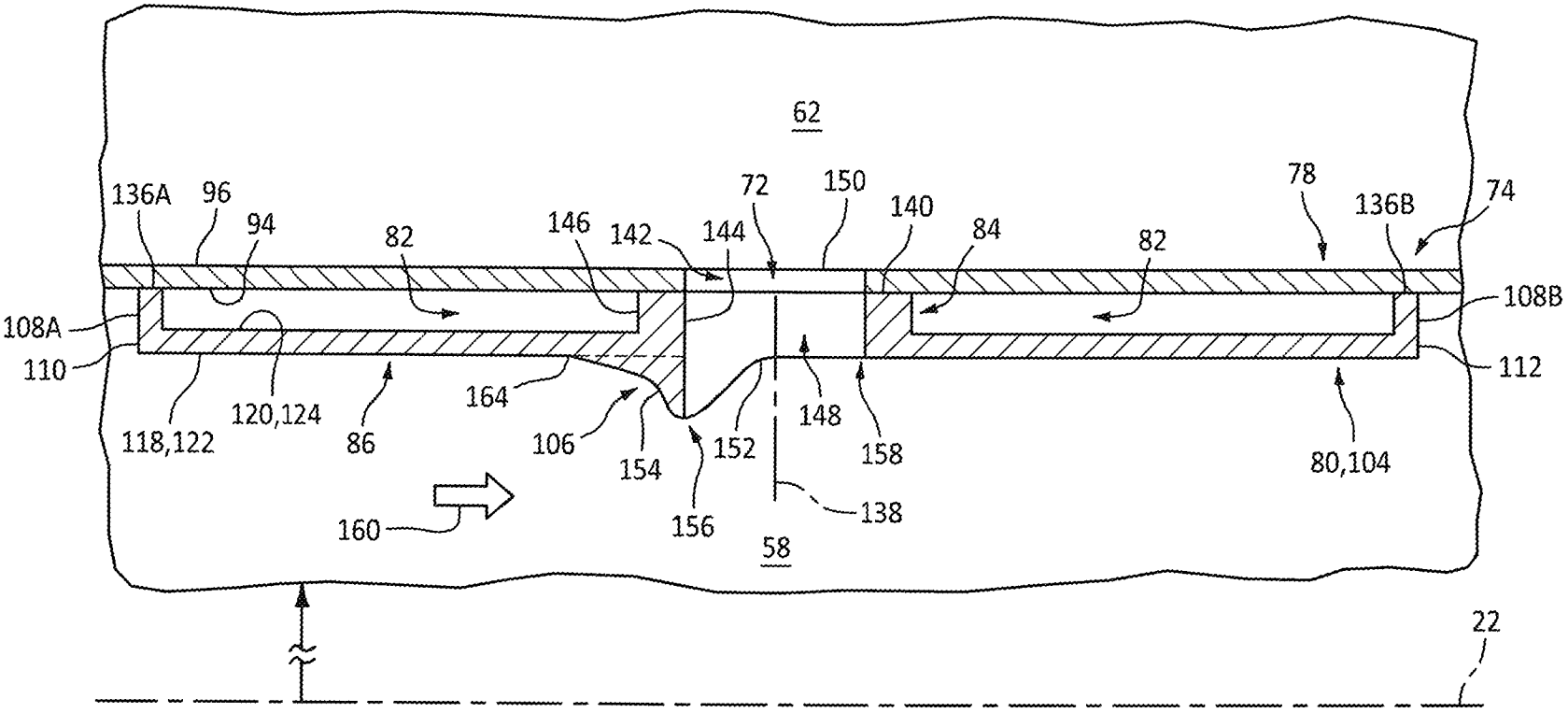
FIG. 4 is a side sectional illustration of a portion of a combustor wall at a quench aperture.

Referring to FIG. 4, each combustor wall 74 may be configured as a multi-walled structure; e.g., a hollow, dual-walled structure. The combustor wall 74 of FIG. 4, for example, includes a tubular combustor shell 78, a tubular combustor heat shield 80 and one or more cooling cavities 82 (e.g., impingement cavities) formed by and radially between the shell 78 and the heat shield 80. However, it is contemplated any one or both of the combustor walls 74A, 74B may alternatively be configured as a single-walled structure where, for example, the shell 78 is omitted and the heat shield 80 forms a single walled liner/combustor wall. However, for ease of description, each combustor wall 74 may be described below as the hollow, dual-walled structure.

Referring to FIG. 4, each combustor wall 74 may include one or more quench aperture bodies. Each aperture body of FIG. 4 is configured as an annular heat shield boss 84 connected to and projecting out from a respective heat shield panel 86. The bosses 84 are arranged circumferentially around the centerline axis 22 in a circular array. Each boss 84 partially or completely forms a respective quench aperture 72 in/radially through the respective combustor wall 74.

Referring to FIG. 2, the shell 78 extends circumferentially about (e.g., completely around) the centerline axis 22. The shell 78 extends axially along the centerline axis 22 between and to an axial upstream end 88 of the shell 78 and an axial downstream end 90 of the shell 78. The shell 78 is connected to the bulkhead 76 at the shell upstream end 88. The shell 78 may be connected to a stator vane assembly 92 (or a structure of the HPT section 31A) at the shell downstream end 90.

Figure 5:
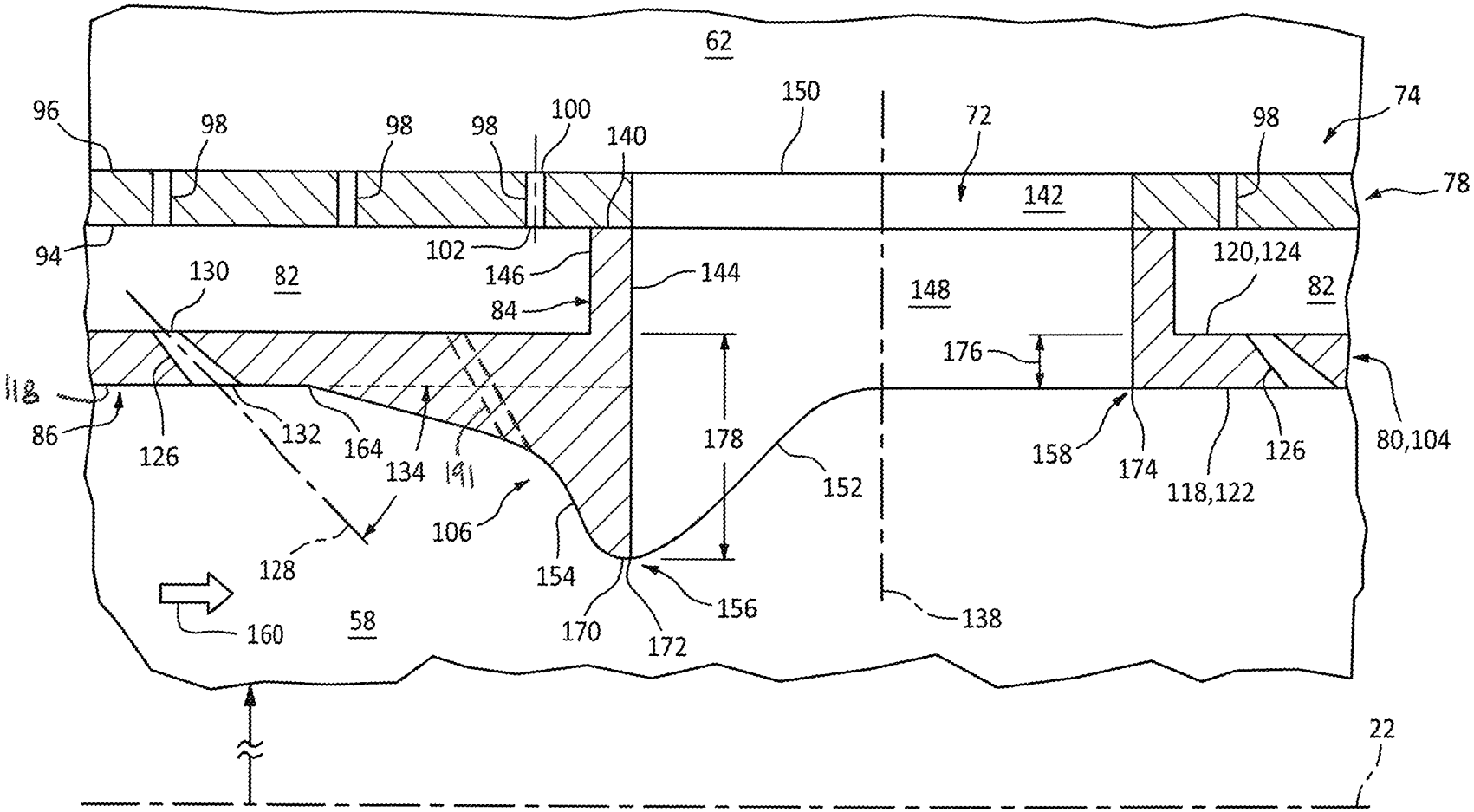
FIG. 5 is a detailed side sectional illustration of a portion of the combustor wall at the quench aperture.

Referring to FIG. 5, the shell 78 extends radially between and to an interior surface 94 of the shell 78 and an exterior surface 96 of the shell 78. The shell exterior surface 96 is adjacent and forms a radial peripheral boundary of the diffuser plenum 62. The shell interior surface 94 is adjacent and forms a radial (e.g., outer or inner) peripheral boundary of each cooling cavity 82.

The shell 78 may include one or more shell cooling apertures 98. Each of these shell cooling apertures 98 may be configured as an impingement aperture. Each shell cooling aperture 98 of FIG. 5, for example, extends (e.g., radially) through the shell 78 from an inlet orifice 100 into the respective shell cooling aperture 98 to an outlet orifice 102 out from the respective shell cooling aperture 98. The inlet orifice 100 is disposed in the shell exterior surface 96. The outlet orifice 102 is disposed in the shell interior surface 94. The shell cooling apertures 98 thereby fluidly couple the diffuser plenum 62 to each respective cooling cavity 82 within the respective combustor wall 74. Each shell cooling aperture 98 is also configured to direct a jet of core air into the respective cooling cavity 82 to impinge against the panel 86.

Referring to FIG. 2, the heat shield 80 extends circumferentially about (e.g., completely around) the centerline axis 22. The heat shield 80 extends axially along the centerline axis 22 between and to an axial upstream end of the heat shield 80 and an axial downstream end of the heat shield 80. The heat shield upstream end is located at an interface between the respective combustor wall 74 and the bulkhead 76. The heat shield downstream end may be located at an interface between the respective combustor wall 74 and the stator vane assembly 92 (or the structure of the HPT section 31A).

The heat shield 80 may include one or more heat shield tiles 104A and 104B (generally referred to as "104"), one or more of which tiles 104 may have an arcuate geometry. The tiles 104A, 104B are respectively arranged at discrete locations along the centerline axis 22. The upstream tiles 104A are arranged circumferentially about the centerline axis 22 and may form an upstream heat shield section/hoop. The downstream tiles 104B are arranged circumferentially about the centerline axis 22 and may form a downstream heat shield section/hoop. The heat shield 80, however, may alternatively be configured from one or more tubular bodies.

Figure 6:
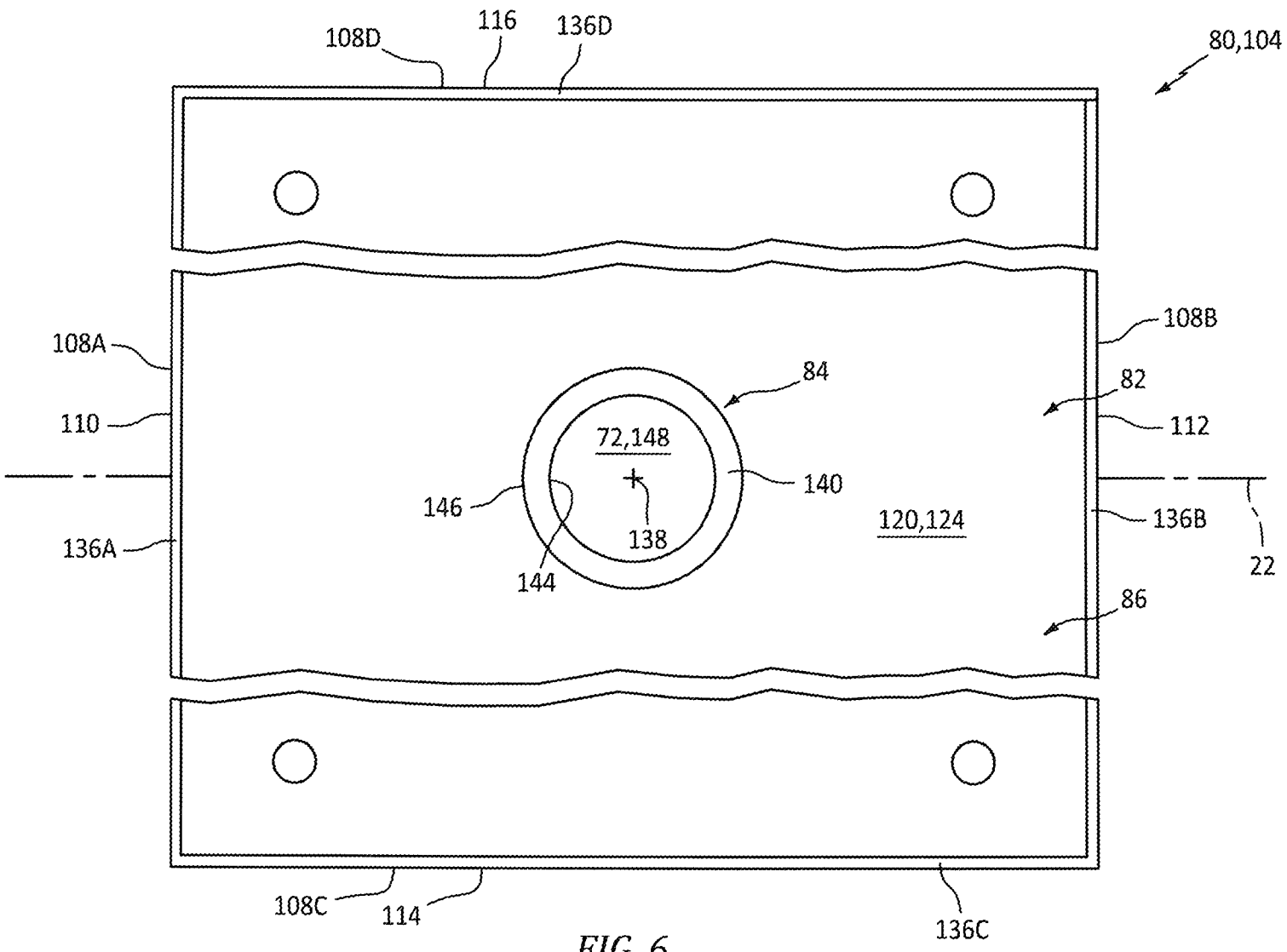
FIG. 6 is a partial illustration of a heat shield tile.

Each tile 104 of FIGS. 4-6 includes a respective one of the panels 86 and at least (or only) one wall deflector 106. Each tile 104 may also include one or more tile rails 108A-D (generally referred to as "108") and/or at least (or only) one of the bosses 84.

Referring to FIGS. 4 and 6, the panel 86 may be configured as a generally curved (e.g., arcuate) plate. The panel 86 of FIGS. 4 and 6 extends axially along the centerline axis 22 between and to an upstream end 110 of the respective tile 104 and its panel 86 and a downstream end 112 of the respective tile 104 and its panel 86. The panel 86 of FIG. 6 extends circumferentially about the centerline axis 22 between and to opposing circumferential sides 114 and 116 of the respective tile 104 and its panel 86. The panel 86 of FIG. 5 extends radially between and to an interior surface 118 of the respective tile 104 and its panel 86 and an exterior surface 120 of the panel 86. The panel interior surface 118 is disposed at (e.g., on, adjacent or proximate) an interior side 122 of the respective tile 104 and its panel 86. The panel interior surface 118 of FIG. 5, for example, is adjacent and forms a radial (e.g., outer or inner) peripheral boundary of the combustion chamber 58. The panel exterior surface 120 is disposed at an exterior side 124 of the panel 86. The panel exterior surface 120 of FIG. 5, for example, is adjacent and forms a radial (e.g., inner or outer) peripheral boundary of the respective cooling cavity 82.

The panel 86 may include one or more of the panel cooling apertures 126. Each of these panel cooling apertures 126 may be configured as an effusion aperture. Each panel cooling aperture 126 of FIG. 5, for example, extends (e.g., generally radially) through the panel 86 along a centerline 128 of the respective panel cooling aperture 126 from an inlet orifice 130 into the respective panel cooling aperture 126 to an outlet orifice 132 out from the respective panel cooling aperture 126. The inlet orifice 130 is disposed at the panel exterior side 124 in the panel exterior surface 120. The outlet orifice 132 is disposed at the panel interior side 122 in the panel interior surface 118. The panel cooling apertures 126 thereby fluidly couple each respective cooling cavity 82 with the combustion chamber 58. Each panel cooling aperture 126 is also configured to direct the core air into the respective combustion chamber 58 to form a film against the panel 86 and its panel interior surface 118. To promote formation of the film, the panel cooling aperture centerline 128 may be angularly offset from the panel interior surface 118 (and/or the panel exterior surface 120) by a non-zero acute angle 134.

Referring to FIGS. 4 and 6, the tile rails 108 may include one or more axial end rails 108A and 108B and/or one or more circumferential side rails 108C and 108D. Each of the tile rails 108 is connected to (e.g., formed integral with or otherwise bonded to) the panel 86. Each of these tile rails 108 projects radially out from the panel 86 and its panel exterior surface 120 to a radial distal end 136A-D (generally referred to as "136") of the respective tile rail 108. Each of these rail distal ends 136 may be configured to radially engage (e.g., contact, abut against, etc.) the shell 78 and its shell interior surface 94.

Referring to FIG. 6, each of the axial end rails 108A, 108B is disposed at a respective one of the panel ends 110, 112. Each of the axial end rails 108A, 108B extends circumferentially along the respective panel end 110, 112 between and to the circumferential side rails 108C and 108D. Each of the circumferential side rails 108C, 108D is disposed at a respective one of the panel sides 114, 116. Each of the circumferential side rails 108C, 108D extends axially along the respective panel side 114, 116 between and to the axial end rails 108A and 108B. With this arrangement, each cooling cavity 82 extends within the respective combustor wall 74 axially between the respective axial end rails 108A and 108B. Each cooling cavity 82 extends within the respective combustor wall 74 circumferentially between the respective circumferential side rails 108C and 108D. Referring to FIG. 5, each cooling cavity 82 extends within the respective combustor wall 74 radially between the respective panel exterior surface 120 and the shell interior surface 94.

Referring to FIG. 6, the boss 84 may be arranged intermediately (e.g., centered or otherwise positioned) within a respective one of the cooling cavities 82. The boss 84 of FIG. 6, for example, is axially between and axially spaced from the respective axial end rails 108A and 108B. The boss 84 of FIG. 6 is further circumferentially between and circumferentially spaced from the respective circumferential side rails 108C and 108D.

The boss 84 of FIG. 5 is connected to (e.g., formed integral with or otherwise bonded to) the panel 86. This boss 84 projects radially (e.g., along a centerline 138 of a respective quench aperture 72) out from the panel 86 and its panel exterior surface 120, radially through the respective cooling cavity 82, to a radial distal end 140 of the boss 84. This boss distal end 140 may be configured to radially engage (e.g., contact, abut against, etc.) the shell 78 and its shell interior surface 94. Here, the boss 84 is (e.g., circumferentially and axially) aligned with and extends circumferentially about a port 142 through the shell 78, which port 142 forms an upstream portion of the respective quench aperture 72. However, the boss 84 may alternatively project radially into or through the port 142 in other embodiments such that the boss 84 forms the upstream portion of the respective quench aperture 72.

The boss 84 of FIG. 5 extends laterally (e.g., radially relative to the quench aperture centerline 138) between and to a tubular (e.g., cylindrical) inner surface 144 of the respective quench aperture 72 and a tubular (e.g., cylindrical) outer surface 146 of the boss 84. The aperture inner surface 144 of FIG. 5 is formed by the boss 84, the panel 86 and the wall deflector 106. This aperture inner surface 144 may form a bore 148 through the heat shield 80, which bore 148 forms a downstream portion of the quench aperture 72 through the respective combustor wall 74. With this arrangement, the quench aperture 72 may extend radially (e.g., longitudinally along the quench aperture centerline 138) through the respective combustor wall 74 from an inlet 150 (e.g., an inlet orifice) into the quench aperture 72 to an outlet 152 (e.g., an orifice orifice) out from the quench aperture 72. The aperture inlet 150 of FIG. 5 is formed by the port 142 and is disposed in the shell exterior surface 96. The aperture outlet 152 of FIG. 4 is formed by the bore 148 and is disposed in the panel interior surface 118 and a surface 154 of the wall deflector 106. For example, an upstream side 156 (e.g., an arcuate leading edge side) of the aperture outlet 152 of FIG. 5 (e.g., relative to a gas flow direction 160 within the combustion chamber 58) as well as a corresponding radially adjacent portion of the aperture inner surface 144 are formed by the wall deflector 106. A downstream side 158 (e.g., an arcuate trailing edge side) of the aperture outlet 152 of FIG. 5 (e.g., relative to the gas flow direction 160 within the combustion chamber 58) as well as a corresponding radially adjacent portion of the aperture inner surface 144 are formed by the panel 86. Note, the gas flow direction 160 may include an axial component along the centerline axis 22 and/or a circumferential component about the centerline axis 22. A ratio of the axial component to the circumferential component may vary based on combustor flow characteristics. However, it is contemplated the ratio of the axial component to the circumferential component may be less than one (1), equal to one (1) or greater than one (1). The ratio may be less than one where there is relatively high swirl about the centerline axis 22. The ratio may be greater than one where there is relatively low swirl about the centerline axis 22. Thus, while the upstream side 156 may be offset (e.g., forward) of the downstream side 158 along the centerline axis 22, the upstream side 156 may also be (e.g., clockwise or counterclockwise) offset of the downstream side 158 about the centerline axis 22. The present disclosure, however, is not limited to any particular flow direction within the combustor 60 and its combustion chamber 58.

Figure 7:
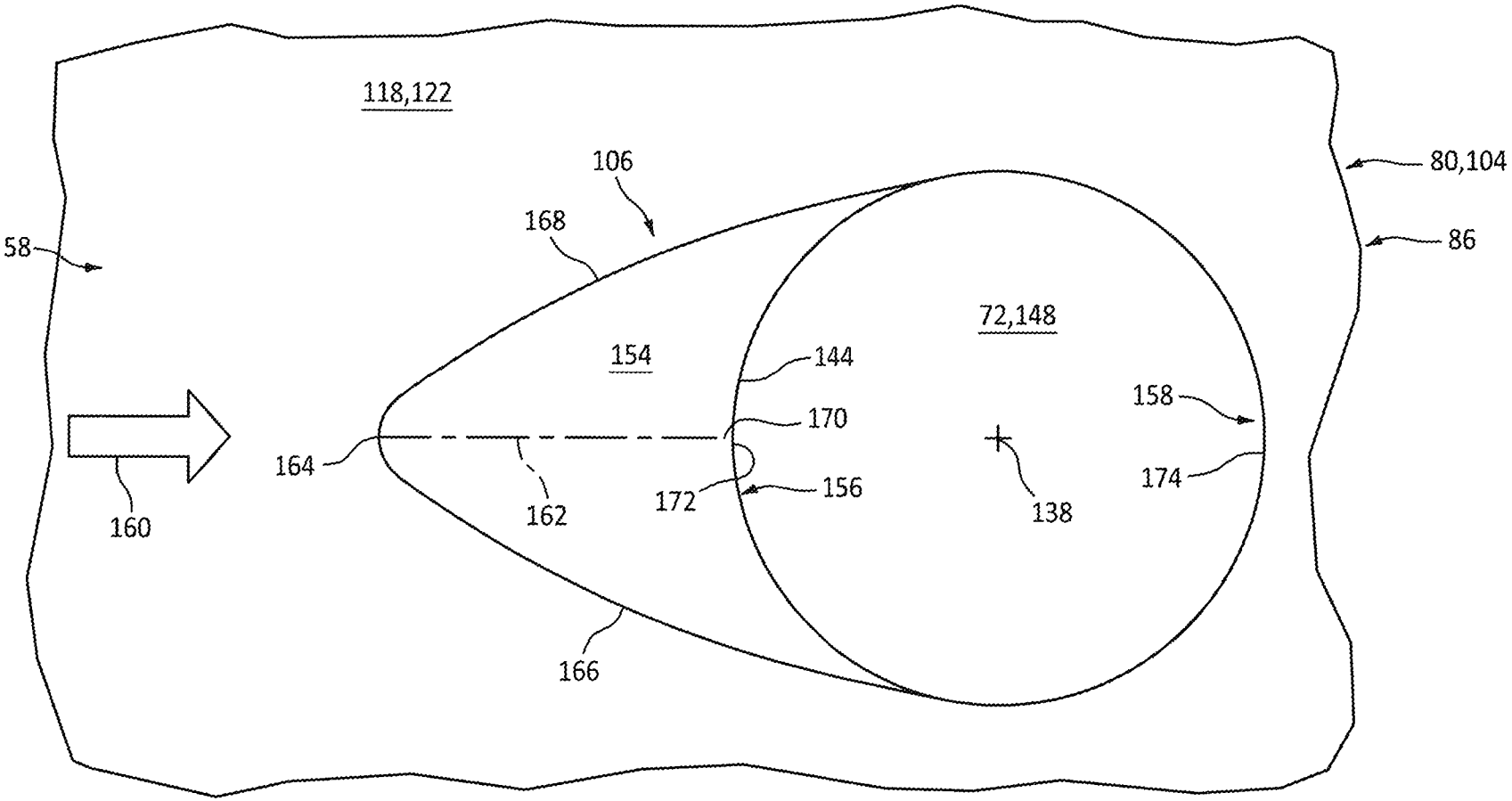
FIG. 7 is a partial illustration of a deflector at an upstream side of the quench aperture.

The wall deflector 106 is connected to (e.g., formed integral with or otherwise bonded to) the panel 86 at the panel interior side 122. The wall deflector 106 projects (e.g., radially) out from the panel 86 and its panel interior surface 118 partially (e.g., slightly) into the combustion chamber 58 to its deflector surface 154. Referring to FIG. 7, the wall deflector 106 projects longitudinally along the panel 86 and a longitudinal centerline 162 of the wall deflector 106 from the aperture inner surface 144 (in a direction away from the quench aperture 72 and its aperture outlet 152) to a distal leading end 164 of the wall deflector 106; e.g., an upstream end of the wall deflector 106 relative to the gas flow direction 160 within the combustion chamber 58. The wall deflector 106 extends laterally between and to opposing lateral sides 166 and 168 of the wall deflector 106. The wall deflector 106 of FIG. 7 may also extend circumferentially about the aperture outlet 152 more than twenty degrees (20°) between the deflector sides 166 and 168, but less than one-hundred and eighty degrees (180°) for example. The wall deflector 106 of FIG. 7, for example, extends circumferentially about the aperture outlet 152 between sixty or eighty degrees (60°, 80°) and one-hundred and twenty or forty degrees (120°, 140°).

Referring to FIG. 5, the wall deflector 106 and its deflector surface 154 may form a ramp in the longitudinal direction away from the panel 86 and its panel interior surface 118. For example, as the wall deflector 106 extends longitudinally from the quench aperture 72 and its aperture outlet 152 to the deflector leading end 164, the wall deflector 106 of FIG. 5 (e.g., continuously) tapers towards (e.g., to) the panel 86 and its panel interior surface 118. The deflector surface 154 of FIG. 5 thereby slopes to the panel interior surface 118 at the deflector leading end 164. The deflector surface 154 of FIG. 5 also slopes away from the panel interior surface 118 at the aperture outlet 152/the outlet upstream side 156.

Figure 8:
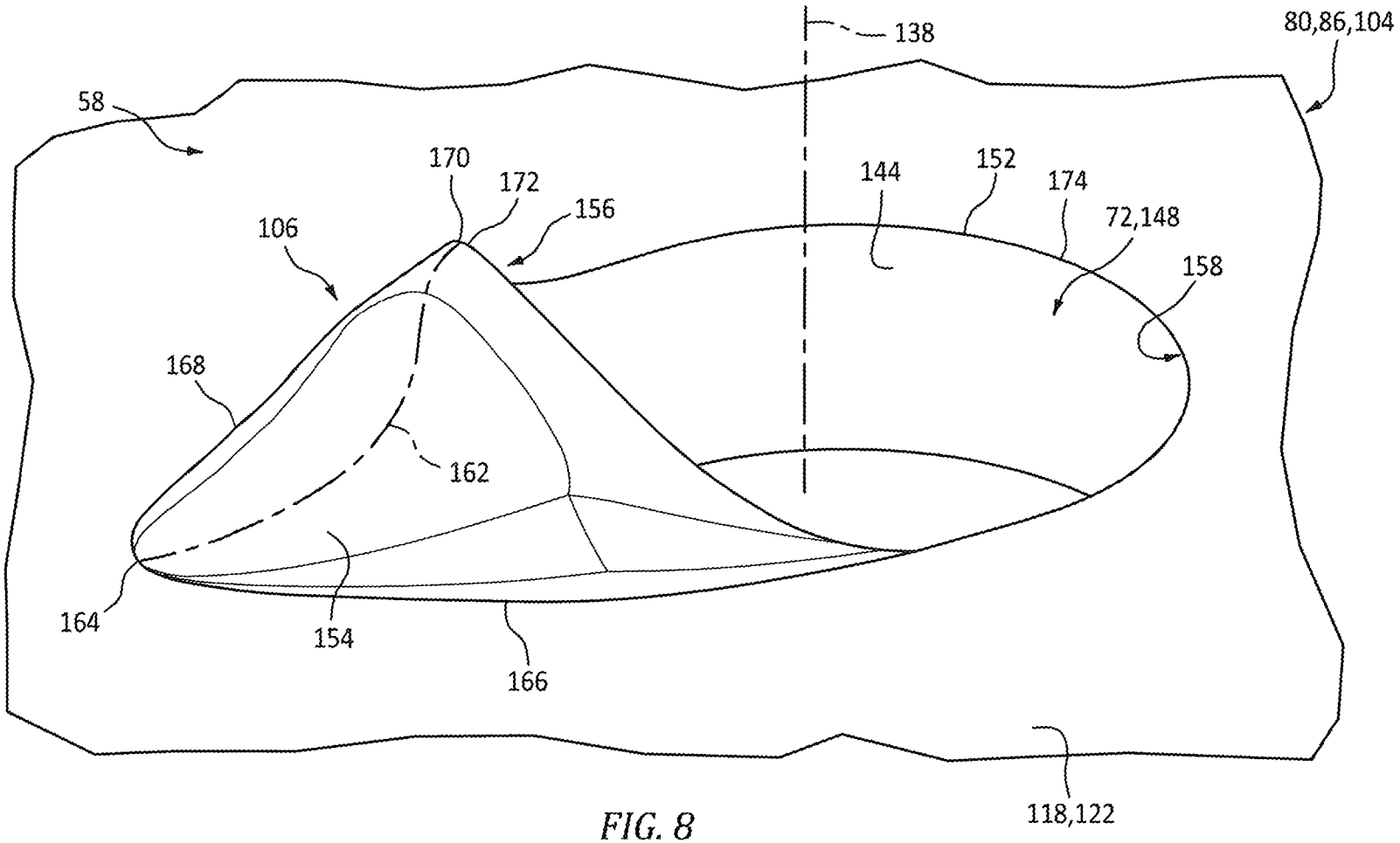
FIG. 8 is a partial perspective illustration of the deflector at the upstream side of the quench aperture.

Referring to FIG. 8, the wall deflector 106 and its deflector surface 154 may also or alternatively form a wedge (e.g., a flow splitter) in the lateral direction away from the deflector centerline 162. For example, as the wall deflector 106 extends laterally to each deflector side 166, 168 away from the deflector centerline 162, the wall deflector 106 of FIG. 8 (e.g., continuously) tapers towards (e.g., to) the panel 86 and its panel interior surface 118. The deflector surface 154 of FIG. 8 thereby slopes to the panel interior surface 118 at each deflector side 166, 168. The deflector surface 154 of FIG. 8 also slopes away from the panel interior surface 118 at or about the deflector centerline 162.

The wall deflector 106 and its deflector surface 154 may have an apex 170 at (e.g., on, adjacent or proximate) the deflector centerline 162 and/or the aperture outlet 152 and its upstream side 156. A peak in the deflector surface 154 of FIG. 8, for example, is (A) disposed on or adjacent an edge 172 (e.g., an exterior corner) of the wall deflector 106 between the deflector surface 154 and the aperture inner surface 144 (see also FIG. 5) and (B) laterally aligned with (or passing across) the deflector centerline 162.

In the longitudinal direction, a geometric slope (e.g., radial rise over longitudinal run) of the taper proximate the aperture outlet 152 may be greater (e.g., steeper) than a geometric slope of the taper proximate the deflector leading end 164. Similarly, in the lateral direction, a geometric slope (e.g., radial rise over lateral run) of the taper proximate the deflector centerline 162 may be greater (e.g., steeper) than a geometric slope of the taper proximate each deflector side 166, 168. The present disclosure, however, is not limited to such an exemplary geometry. For example, in other embodiments, the geometric slope of the taper in the longitudinal direction and/or the taper in the lateral direction may be substantially or completely uniform (e.g., constant) along at least a portion or an entirety of the wall deflector 106.

Figure 9A:
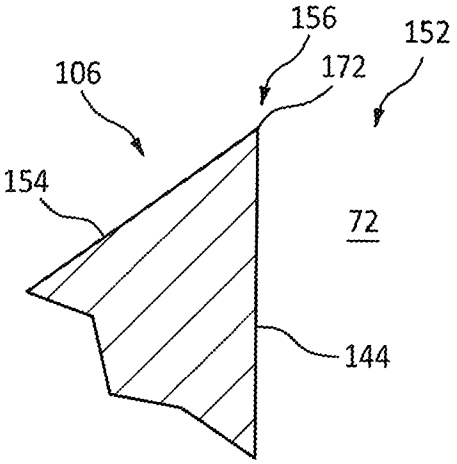
FIGS. 9A and 9B are partial sectional illustrations of a deflector edge with various configurations.
Figure 9B:
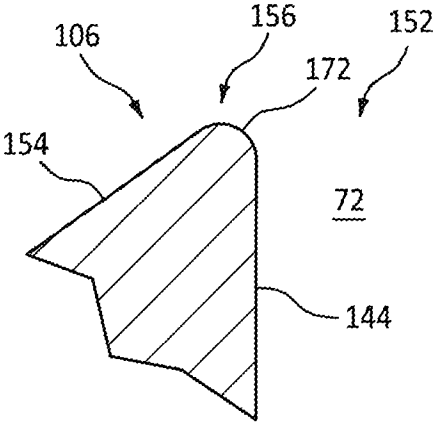
Figure 10A:
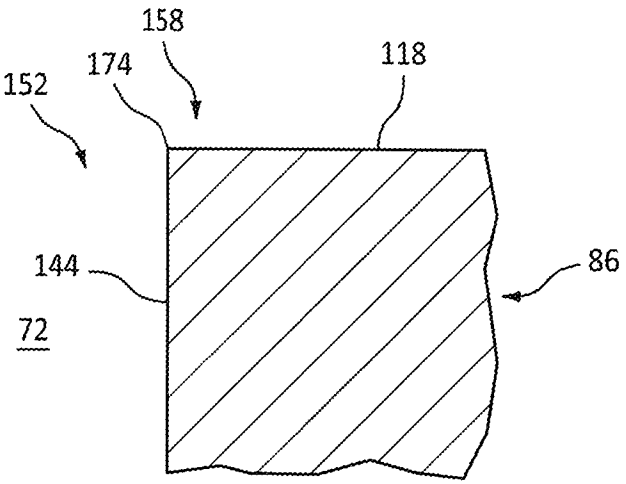
FIGS. 10A and 10B are partial sectional illustrations of a panel edge with various configurations.
Figure 10B:
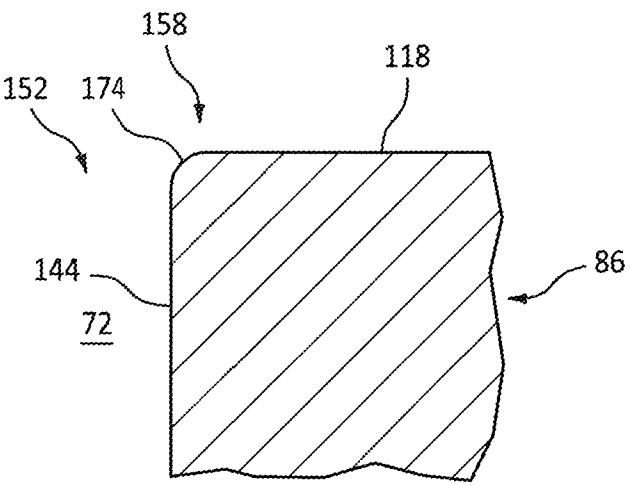

Referring to FIGS. 9A and 9B, the deflector surface 154 may be contiguous with and meet the aperture inner surface 144 at the deflector edge 172 along the upstream side 156 of the aperture outlet 152. Referring to FIG. 9A, the deflector edge 172 may be configured as a sharp edge. Alternatively, referring to FIG. 9B, the deflector edge 172 may be configured as an eased edge; e.g., a rounded edge or a beveled edge. Similarly, referring to FIGS. 10A and 10B, the panel interior surface 118 may be contiguous with and meet the aperture inner surface 144 at an edge 174 of the panel 86 (e.g., an exterior corner) along the downstream side 158 of the aperture outlet 152. Referring to FIG. 10A, the panel edge 174 may be configured as a sharp edge. Alternatively, referring to FIG. 10B, the panel edge 174 may be configured as an eased edge; e.g., a rounded edge or a beveled edge.

With the foregoing arrangement, referring to FIG. 5, the downstream side 158 of the aperture outlet 152 and, thus, the panel interior surface 118/the panel interior side 122 are spaced from the panel exterior surface 120/the panel exterior side 124 by a first distance 176. The first distance 176 of FIG. 5 is a thickness of the panel 86. The upstream side 156 of the aperture outlet 152 and, thus, the deflector surface 154 are spaced from the panel exterior surface 120/the panel exterior side 124 by a second distance 178. The second distance 178 of FIG. 5 is a combined thickness of the panel 86 and the wall deflector 106. The second distance 178 is thereby greater than the first distance 176.

Figure 11:
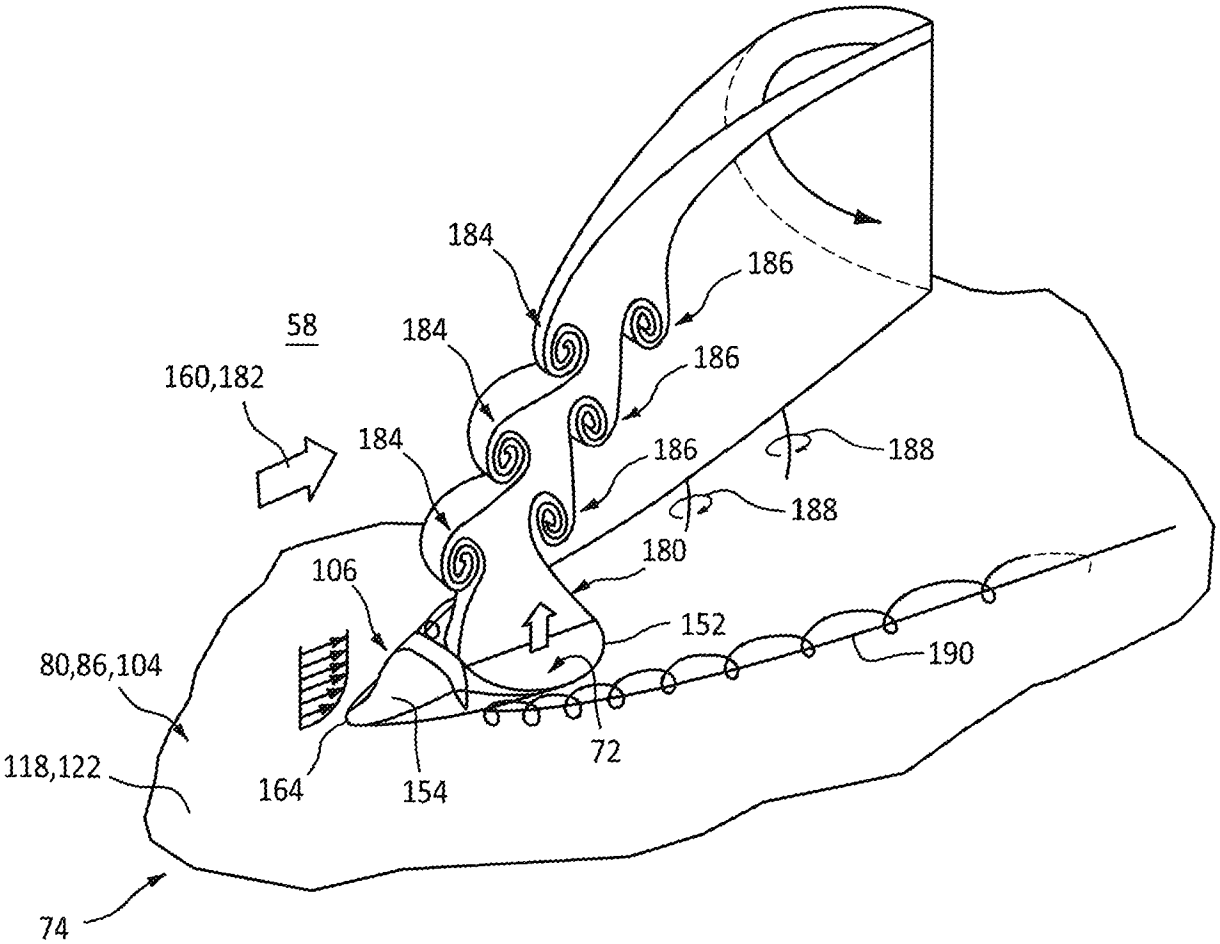
FIG. 11 is a partial perspective schematic illustration of quench air injected into a combustion chamber during turbine engine operation.

Referring to FIG. 11, during turbine engine operation, each quench aperture 72 directs a jet of the quench air 180 into the combustion chamber 58 through its aperture outlet 152. This jet of quench air 180 penetrates radially into a flow of the combustion products 182 within the combustion chamber 58. Some of a boundary flow of the combustion products 182 and/or cooling air (e.g., introduced via the panel cooling apertures 126; see FIG. 5) moving along the combustor wall 74 is directed laterally around the aperture outlet 152 by the wall deflector 106. Some of the boundary flow of the combustion products 182 and/or the cooling air may also or alternatively be directed radially deeper into the combustion chamber 58 generally in a direction of the jet of the quench air 180 by the wall deflector 106. By redirecting the boundary flow of the combustion products 182 and/or the cooling air, the wall deflector 106 may influence (e.g., tailor) one or more vortex systems generated by mixing between the combustion products 182 and the quench air 180. These vortex systems may include, but are not limited to, a leading-edge vortices 184, lee-side vortices 186, wake vortices 188 and/or horseshoe vortices 190. This influencing of the vortex system(s) may reduce (e.g., circumferential) variations in downstream mixing and thereby reduce (e.g., circumferential) variations in pattern factor. The influencing of the vortex system(s) may also or alternatively reduce entrainment of combustion products and/or cooling air near the combustor wall 74 downstream of the aperture outlet 152. Reducing one or more of the foregoing parameters may thereby increase combustion section component and/or turbine section component durability/longevity and/or reduce combustion section cooling requirements and/or turbine section cooling requirements.

In some embodiments, referring to FIG. 5, one or more or all of the deflectors 106 may each be configured with one or more cooling apertures 191 (schematically shown); e.g., effusion apertures. Such cooling aperture(s) 191 may provide and/or extend existing film cooling along the deflector surface 154.

In some embodiments, one or more protective coatings (e.g., thermal barrier coating(s), etc.) applied to the panel interior surface 118 may also be applied to one or more portions of each deflector 106. The coating(s), for example, may be applied to and cover part or all of the deflector surface 154.

While the wall deflectors 106 are described above with respect to the quench apertures 72, it is contemplated the wall deflectors 106 may also or alternatively be utilized to in conjunction with one or more igniter apertures 192 (see FIGS. 2 and 3) through a respective combustor wall 74. The present disclosure therefore is not limited to quench aperture applications, but rather may be utilized for any (e.g., non-cooling hole) wall aperture through a respective combustor wall 74.

The combustor wall 74 and its wall deflector(s) 106 may be included in various turbine engines other than the one described above. The combustor wall 74 and its wall deflector(s) 106, for example, may be included in a geared turbine engine where a geartrain connects one or more shafts to one or more rotors in a fan section, a compressor section and/or any other engine section. Alternatively, the combustor wall 74 and its wall deflector(s) 106 may be included in a turbine engine configured without a geartrain; e.g., a direct drive turbine engine. The combustor wall 74 and its wall deflector(s) 106 may be included in a geared or non-geared turbine engine configured with a single spool, with two spools (e.g., see FIG. 1), or with more than two spools. The turbine engine may be configured as a turbofan engine, a turbojet engine, a turboprop engine, a turboshaft engine, a propfan engine, a pusher fan engine or any other type of turbine engine. The turbine engine may alternatively be configured as an auxiliary power unit (APU) or an industrial gas turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A combustor for a turbine engine, comprising:

a combustor wall including a panel, a deflector and a quench aperture that extends along an aperture centerline through the combustor wall to an aperture outlet into a combustion chamber;

a gas flow direction within the combustor extending along an axis, the gas flow direction extending from an upstream end of the combustor wall to a downstream end of the combustor wall;

the panel extending axially along and circumferentially about the axis, the panel extending radially between a first panel side and a second panel side, the first panel side forming a peripheral boundary of the combustion chamber, and the panel forming a downstream side of the aperture outlet at the first panel side; and the deflector connected to and projecting out from the panel at the first panel side into the combustion chamber, and the deflector forming an upstream side of the aperture outlet that is upstream of the downstream side along the gas flow direction, wherein a straight portion of the panel is radially adjacent and connected to the deflector axially and circumferentially;

wherein the second panel side is spaced from the aperture outlet along the aperture centerline by a first distance at the downstream side of the aperture outlet, the second panel side is spaced from the aperture outlet along the aperture centerline by a second distance at the upstream side of the aperture outlet, the first distance is a thickness of the panel, the second distance is a combined thickness of the panel and the deflector, and the second distance is greater than the first distance.

2. The combustor of claim 1, wherein the deflector projects out from the panel to a deflector surface;

a tubular surface of the combustor wall forms at least a portion of the quench aperture that extends along the aperture centerline to the aperture outlet; and the tubular surface is contiguous with the deflector surface.

3. The combustor of claim 1, wherein a tubular surface of the combustor wall forms at least a portion of the quench aperture that extends along the aperture centerline to the aperture outlet; and the tubular surface is formed by the panel and the deflector.

4. The combustor of claim 1, wherein the deflector tapers to the panel as the deflector extends longitudinally away from the aperture outlet to a leading end of the deflector.

5. The combustor of claim 4, wherein a slope of the taper proximate the aperture outlet is greater than a slope of the taper proximate the leading end of the deflector.

6. The combustor of claim 4, wherein the deflector tapers to the panel as the deflector extends laterally to a first side of the deflector.

7. The combustor of claim 6, wherein the deflector tapers to the panel as the deflector extends laterally to a second side of the deflector that is laterally opposite the first side of the deflector.

8. The combustor of claim 1, wherein the deflector projects out from the panel to a deflector surface; and an apex of the deflector surface is located at the upstream side of the aperture outlet.

9. The combustor of claim 1, wherein the deflector extends circumferentially about the aperture outlet between sixty degrees and one-hundred and forty degrees.

10. The combustor of claim 2, wherein the upstream side of the aperture outlet is formed by an edge of the deflector where the deflector surface meets the tubular surface at a point.

11. The combustor of claim 1, wherein the downstream side of the aperture outlet is formed by an edge of the panel where an interior surface of the panel meets a tubular surface at a point.

12. The combustor of claim 1, wherein the downstream side of the aperture outlet is formed by an eased edge of the panel, and the eased edge of the panel comprises a rounded edge or a beveled edge of the panel.

13. The combustor of claim 1, wherein the combustor wall further includes a boss;

the boss projects out from the panel at the second panel side; and the boss extends circumferentially around and forms an outer peripheral boundary of the quench aperture within the combustor wall.

14. The combustor of claim 13, wherein the combustor wall further includes a heat shield and a shell;

the heat shield includes the panel, the deflector and the boss, and the heat shield is attached to the shell; and the boss projects out from the panel to a distal end of the boss, and the distal end engages the shell.

15. The combustor of claim 1, wherein the combustor wall further includes one or more cooling apertures projecting through the panel.

16. A combustor for a turbine engine, comprising:

a combustor wall including a panel, a deflector, a cooling aperture and a wall aperture that extends along an aperture centerline through the combustor wall to an aperture outlet into a combustion chamber;

a gas flow direction within the combustor extending along an axis, the gas flow direction extending from an upstream end of the combustor wall to a downstream end of the combustor wall;

the panel extending axially along and circumferentially about the axis, the panel extending radially between a first panel surface and a second panel surface, and the first panel surface forming a peripheral boundary of the combustion chamber;

the deflector projecting radially out from the panel into the combustion chamber to a deflector surface, the deflector partially forming the aperture outlet, the deflector surface sloping away from the first panel surface as the deflector extends longitudinally towards the aperture outlet, and the deflector surface sloping to the first panel surface as the deflector extends longitudinally from the aperture outlet; and the cooling aperture extending between the deflector surface and a cooling cavity, the cooling aperture having an upstream side and a downstream side, the cooling aperture having a cooling aperture centerline that is angularly offset from the panel by a constant non-zero acute angle, and the cooling aperture projecting through the entirety of the deflector at the constant non-zero acute angle along the cooling aperture centerline;

wherein the upstream side of the cooling aperture is upstream of the downstream side of the cooling aperture along the gas flow direction;

wherein the panel forms a trailing edge side of the aperture outlet relative to the gas flow direction within the combustion chamber; and wherein the deflector forms a leading edge side of the aperture outlet relative to the gas flow direction within the combustion chamber.

17. The combustor of claim 16, wherein the wall aperture comprises a quench aperture.

* * * * *